US009733032B2

(12) United States Patent
Courtot et al.

(10) Patent No.: US 9,733,032 B2
(45) Date of Patent: Aug. 15, 2017

(54) FIRE RESTRAINING DEVICE FOR SELECTIVE INTELLIGENT FIRING

(71) Applicants: Timothy M Courtot, Cresson, PA (US); Timothy M Courtot, Jr., Cresson, PA (US)

(72) Inventors: Timothy M Courtot, Cresson, PA (US); Timothy M Courtot, Jr., Cresson, PA (US)

( * ) Notice: Subject to any disclaimer, the term of this patent is extended or adjusted under 35 U.S.C. 154(b) by 0 days.

(21) Appl. No.: 15/044,695

(22) Filed: Feb. 16, 2016

(65) Prior Publication Data

US 2016/0169605 A1 Jun. 16, 2016

Related U.S. Application Data

(60) Provisional application No. 62/241,465, filed on Oct. 14, 2015.

(51) Int. Cl.
*F41A 17/46* (2006.01)
*F41A 17/48* (2006.01)
*F41A 17/08* (2006.01)

(52) U.S. Cl.
CPC ..... *F41A 17/48* (2013.01); *F41A 17/08* (2013.01); *F41A 17/46* (2013.01)

(58) Field of Classification Search
CPC ..... F41A 17/46; F41A 17/82
USPC ..... 42/70.06
See application file for complete search history.

(56) References Cited

U.S. PATENT DOCUMENTS 5,564,211 A * 10/1996 Mossberg ..... F41A 17/08 42/70.01
2011/0063102 A1* 3/2011 Ivtsenkov ..... F41A 17/063 340/505

FOREIGN PATENT DOCUMENTS

DE 29 40 513 * 4/1981

* cited by examiner

*Primary Examiner* — Stephen M Johnson
(74) *Attorney, Agent, or Firm* — Barry Choobin; Patent 360

(57) ABSTRACT

The various embodiments herein provide a fire restraining device for selective target shooting in a weapon with a safety lock comprises an infrared sensor, a central computing unit, and a rack and pinion or a shot pin module. The infrared sensor detects a temperature of a target in front of a nozzle of the weapon. The infrared sensor is connected to the central computing unit. The infrared sensor sends the temperature data of the target to the central computing unit. The rack and pinion module or the shot pin module is connected with the central computing unit at one side and the safety lock on another end. The present fire restraining device allows a gunner to control the firing shots over a human or unwanted targets which reduces false fatalities in close combats.

5 Claims, 3 Drawing Sheets

FIRE RESTRAINING DEVICE FOR SELECTIVE INTELLIGENT FIRING

This application claims domestic priority of from U.S. provisional application No. 62/241,465, filed on Oct. 14, 2015.

BACKGROUND

Technical Field of Invention

The embodiments herein generally relate to an ammunition control device and particularly relates to a fire restraining device for selective intelligent firing. The embodiments herein further relate to a device for controlling an ammunition firing over a human or an unwanted target.

Description of Related Art

A fire-control system is a number of components working together, usually a gun data computer, a director, and radar, which is designed to assist a weapon system in hitting its target. It performs the same task as a human gunner firing a weapon, but attempts to do so faster and more accurately.

Out of modern fire control mechanisms in a weapon, one prior art discloses a weapon firing system is provided with a control including a seismic sensor and an infrared radiation sensor. A source of power is provided which is connected to the seismic sensor and which is connected via a switch with the infrared radiation sensor. The switch is actuated by the seismic sensor so that the infrared radiation sensor does not constitute a constant drain on the power source. The seismic sensor is capable of distinguishing between different types of vehicles characterized by different seismic frequency patterns. The system is provided with a weapon firing control having a jamming circuit which avoids the consequences of transients when signals are initially received from the sensors. The weapon firing control circuit includes a thyristor.

Yet another prior art discloses a device for firing a small or medium caliber firearm includes a rangefinder, an infrared detector supplying an electrical signal, an electronic triggering assembly for controlling firing, and an electrical energy source. The triggering assembly is associated with percussion firing, using an electromagnet connected to the firing pin of the weapon. Firing of the firearm is activated by the detection of the heat signature of a target with the infrared detector. However, the prior arts are limited in controlling a weapon firing over an unwanted or a human target. The prior arts only control a firing rounds of the weapon but during a close encounter or a search operation in a low visibility area, a weapon operator fails to distinguish between a human target and a non-human target leading to fatal accidents and also loss of bullets.

In the view of foregoing, there is a need of a device for restraining a weapon firing on the basis of detection of a human target.

The above mentioned shortcomings, disadvantages and problems are addressed herein, as detailed below.

SUMMARY OF THE INVENTION

The primary objective of the embodiment herein is to provide a device for restraining a weapon firing on the basis of detection of a human target.

The various embodiments herein provide a fire restraining device for selective target shooting in a weapon with a safety lock comprises an infrared sensor, a central computing unit, and a rack and pinion module. The infrared sensor detects a temperature of a target in front of a nozzle of the weapon.

The infrared sensor is connected to the central computing unit. The infrared sensor sends the temperature data of the target to the central computing unit. The rack and pinion module comprises a rack and a pinion. The rack and pinion module is connected with the central computing unit at one side and the safety lock on another end. The central computing unit activates the pinion to move the rack in a counter-clockwise direction to engage safety lock on detecting a temperature data sent from the infrared sensor in a "unwanted temperature range".

According to one embodiment herein, the unwanted temperature range is 85-105 degree Fahrenheit.

According to one embodiment herein, the central computing unit activates the pinion in a clockwise direction to disengage the safety lock on detecting the temperature data sent from the infrared sensor outside the "unwanted temperature range".

The embodiments herein provide a fire restraining device for selective target shooting in a weapon with a safety lock comprises an infrared sensor, a central computing unit, and a shot pin module. The infrared sensor detects a temperature of a target in front of a nozzle of the weapon. The infrared sensor is connected to the central computing unit. The infrared sensor sends the temperature data of the target to the central computing unit. The shot pin module is connected with the central computing unit at one side. The central computing unit activates the shot pin module in a forward direction to disenable a trigger on detecting a temperature data sent from the infrared sensor in a "unwanted temperature range".

According to one embodiment herein, the unwanted temperature range is 85-105 degree Fahrenheit.

According to one embodiment herein, the central computing unit activates the shot pin module to move in a backward direction to enable the trigger on detecting the temperature data sent from the infrared sensor outside the "unwanted temperature range".

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

DETAILED DESCRIPTION OF THE DRAWINGS

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1A:
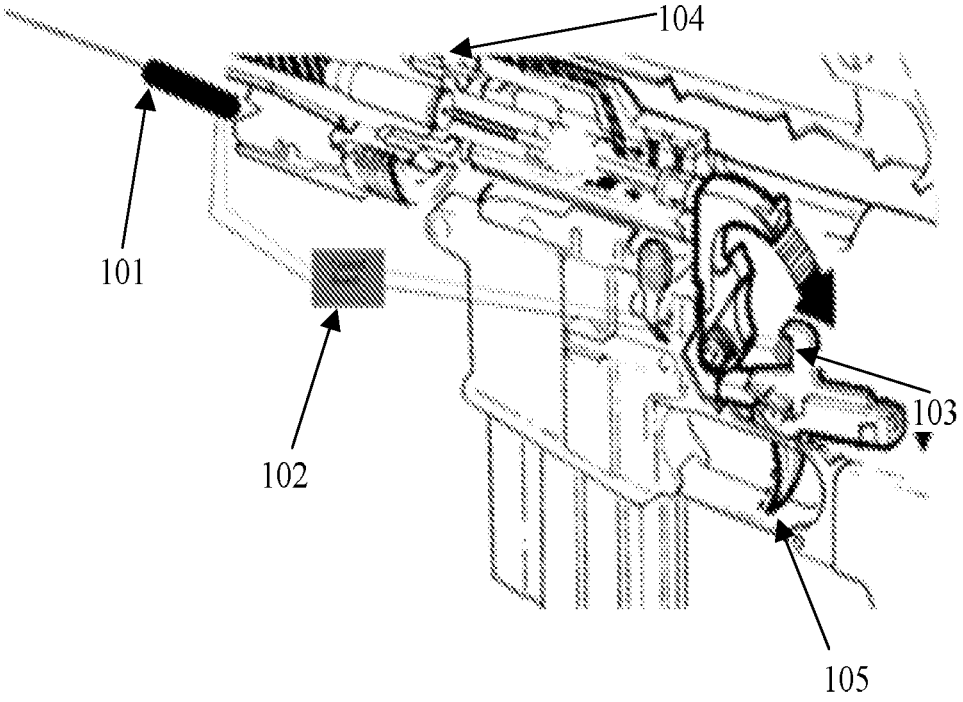
FIG. 1A illustrates a schematic diagram for a fire restraining device aimed over selective intelligent firing with a trigger lock, according to one embodiment herein.
Figure 1B:
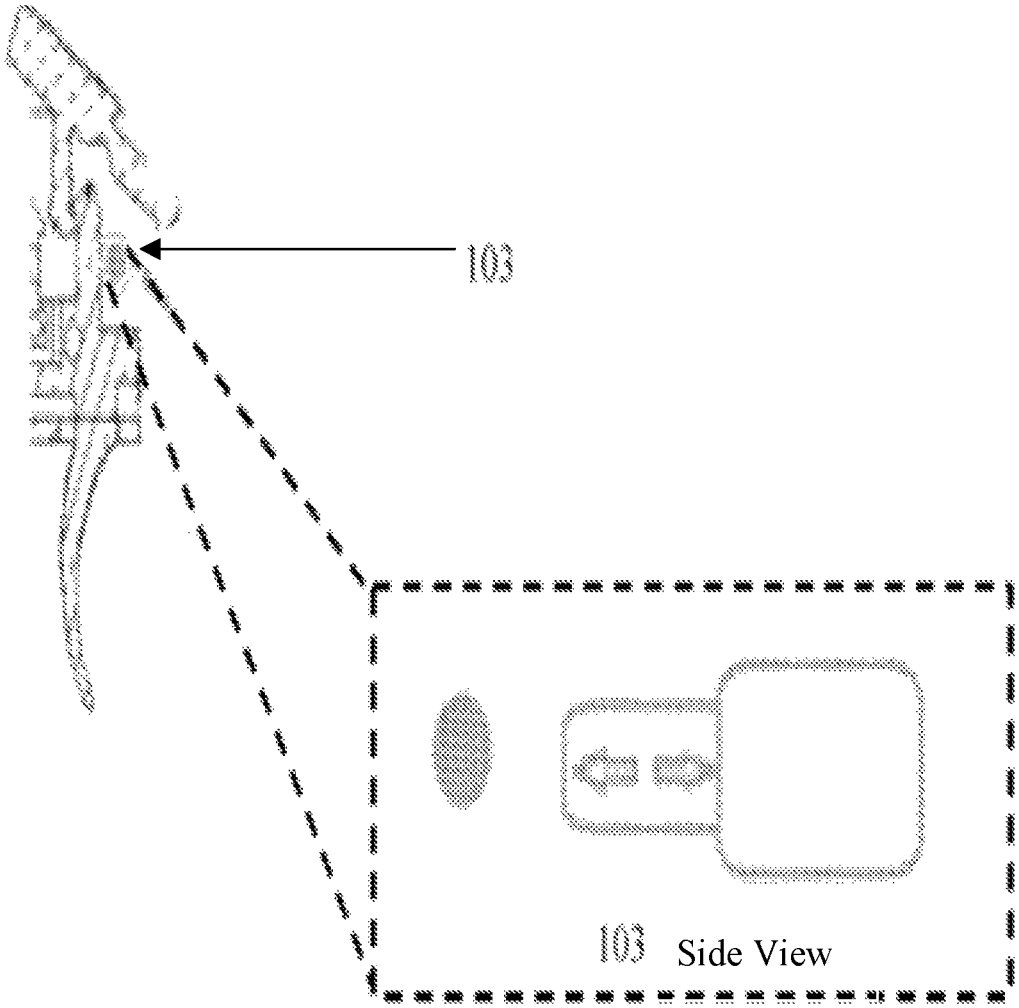
FIG. 1B illustrates a block diagram for a trigger lock of the fire restraining device aimed over selective intelligent firing, according to one embodiment herein.

FIG. 1A illustrates a schematic diagram for a fire restraining device aimed over selective intelligent firing with a trigger lock, according to one embodiment herein. FIG. 1B illustrates a block diagram for a trigger lock of the fire restraining device aimed over selective intelligent firing, according to one embodiment herein. With respect to FIGS. 1A and 1B, the fire restraining device for selective target shooting in a weapon 104 with a safety lock comprises an infrared sensor 101, a central computing unit 102, and a shot pin module 103. The infrared sensor 101 detects a temperature of a target in front of a nozzle of the weapon 104. The infrared sensor 101 is connected to the central computing unit 102. The infrared sensor 101 sends the temperature data of the target to the central computing unit 102. The shot pin module 103 is connected with the central computing unit 102 at one side. The central computing unit 102 activates the shot pin module 103 in a forward direction to disenable a trigger 105 on detecting a temperature data sent from the infrared sensor 101 in a "unwanted temperature range".

According to one embodiment herein, the unwanted temperature range is 85-105 degree Fahrenheit.

According to one embodiment herein, the central computing unit activates the shot pin module to move in a backward direction to enable the trigger on detecting the temperature data sent from the infrared sensor outside the "unwanted temperature range".

According to one embodiment herein, the infrared device detects whether or not the weapon is aiming at a human target (by temperature) and then transmits back to the control panel (central computing unit) which sends the signal to the actuator (a safety lock or a trigger lock), thereby disabling the weapon.

Different weapons use different triggering styles which varies on the basis of a weapon model. The design of the fire restraining device is adaptable to the triggering style of the weapon.

Any alterations to the fire restraining device like trying to remove or disable the device puts the safety "on".

When the batteries are low, the fire restraining device automatically put the safety "on".

Figure 2:
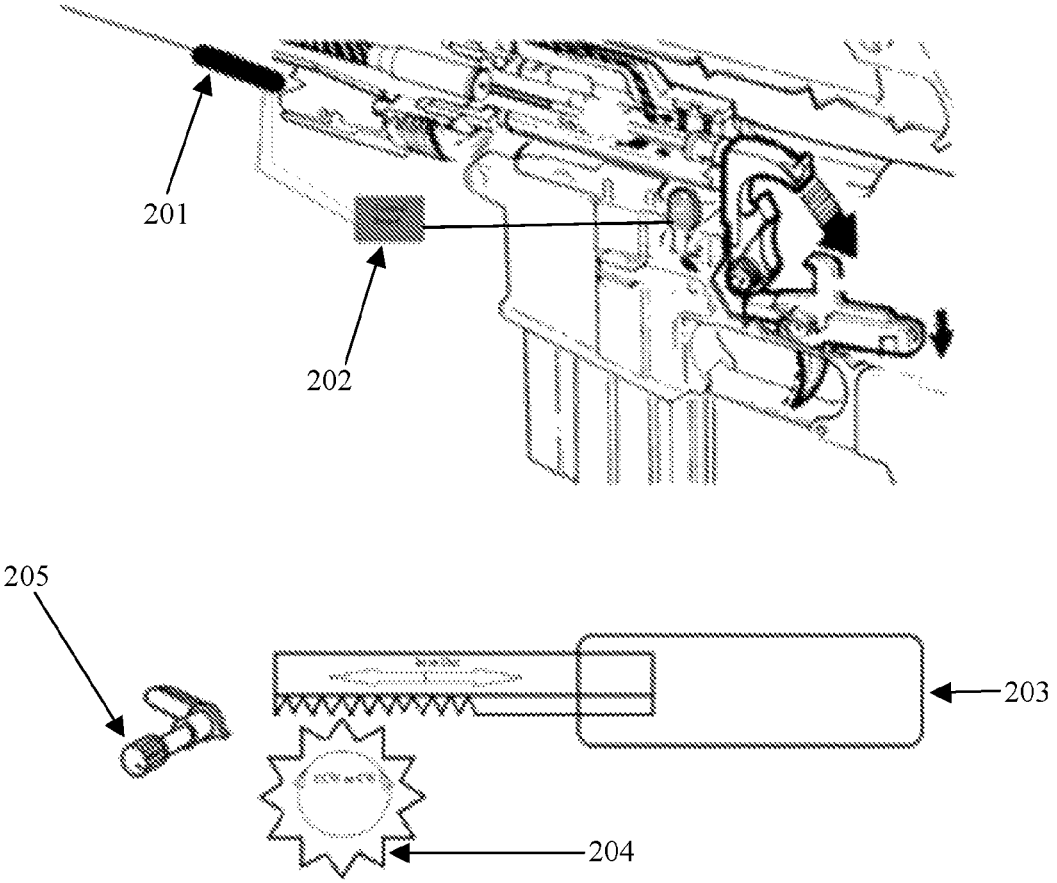
FIG. 2 illustrates a block diagram for a safety lock of the fire restraining device aimed over selective intelligent firing, according to one embodiment herein.

FIG. 2 illustrates a block diagram for a safety lock of the fire restraining device aimed over selective intelligent firing, according to one embodiment herein. With respect to FIG. 3, the fire restraining device for selective target shooting in a weapon with a safety lock comprises an infrared sensor 201, a central computing unit 202, and a rack and pinion module. The infrared sensor 201 detects a temperature of a target in front of a nozzle of the weapon. The infrared sensor 201 is connected to the central computing unit 202. The infrared sensor 201 sends the temperature data of the target to the central computing unit 202. The rack and pinion module comprises a rack 203 and a pinion 204. The rack and pinion module is connected with the central computing unit 202 at one side and the safety lock 205 on another end. The central computing unit 202 activates the pinion 204 to move the rack 203 in a counter-clockwise direction to engage the safety lock 205 on detecting a temperature data sent from the infrared sensor 201 in a "unwanted temperature range".

According to one embodiment herein, the unwanted temperature range is 85-105 degree Fahrenheit.

According to one embodiment herein, the central computing unit activates the pinion in a clockwise direction to disengage the safety lock on detecting the temperature data sent from the infrared sensor outside the "unwanted temperature range".

The present fire restraining device allows a gunner to control the firing shots over a human or unwanted targets which reduces false fatalities in close combats. Also due to a least complex design, the present fire restraining device is adaptable to fitted in a wide range of firing weapons.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims.

What is claimed is:

1. A fire restraining device for selective target shooting in a weapon with a safety lock comprises:

an infrared sensor, wherein the infrared sensor detects a temperature of a target in front of a nozzle of the weapon;

a central computing unit, wherein the infrared sensor is connected to the central computing unit, wherein the infrared sensor sends a temperature data of the target to the central computing unit;

a rack and pinion module, wherein the rack and pinion module comprises a rack and a pinion, wherein the rack and pinion module is connected with the central computing unit at one side and the safety lock on another end;

wherein the central computing unit activates the pinion to move the rack in a counter-clockwise direction to engage the safety lock on detecting the temperature data sent from the infrared sensor in a "unwanted temperature range".

2. The fire restraining device according to claim 1, wherein the unwanted temperature range is 85-105 degree Fahrenheit.

3. The fire restraining device according to claim 1, wherein the central computing unit activates the pinion in a clockwise direction to disengage the safety lock on detecting the temperature data sent from the infrared sensor outside the "unwanted temperature range".

4. A fire restraining device for selective target shooting in a weapon with a safety lock comprises:

an infrared sensor, wherein the infrared sensor detects a temperature of a target in front of a nozzle of the weapon;

a central computing unit, wherein the infrared sensor is connected to the central computing unit, and wherein the infrared sensor sends a temperature data of the target to the central computing unit;

a shot pin module, wherein the shot pin module is connected with the central computing unit at one side;

wherein the central computing unit activates the shot pin module in a forward direction to disenable a trigger on detecting the temperature data sent from the infrared sensor in a "unwanted temperature range".

5. The fire restraining device according to claim 4, wherein the central computing unit activates the shot pin module to move in a backward direction to enable the trigger on detecting the temperature data sent from the infrared sensor outside the "unwanted temperature range".

* * * * *